United States Patent [19]

Wanat

[11] 4,284,966

[45] Aug. 18, 1981

[54] WIDE BANDWIDTH HELICAL RESONATOR FILTER

[75] Inventor: Ronald J. Wanat, Elgin, Ill.

[73] Assignee: Motorola, Inc., Schaumburg, Ill.

[21] Appl. No.: 106,413

[22] Filed: Dec. 21, 1979

[51] Int. Cl.[3] ..... H01P 1/201; H01P 7/00

[52] U.S. Cl. ..... 333/202; 333/222

[58] Field of Search ..... 333/202, 219, 227, 230, 333/231, 235, 212, 245, 248, 132, 175–176, 134–136; 29/592 R, 600; 455/286, 307, 339

[56] References Cited

U.S. PATENT DOCUMENTS

| | | | |
|---|---|---|---|
| 3,093,803 | 6/1963 | Schlicke et al. | 333/210 |
| 3,159,803 | 12/1964 | Czubiak et al. | 333/203 |
| 3,247,475 | 4/1966 | Buetow et al. | 333/231 |
| 3,284,728 | 11/1966 | Poschenrieder | 333/186 |
| 3,293,644 | 12/1966 | Loos et al. | 333/124 |
| 3,387,236 | 6/1968 | Womack, Jr. | 333/224 |
| 3,571,768 | 3/1971 | Gundry | 333/230 |
| 3,581,249 | 5/1971 | Spangler et al. | 336/136 X |
| 3,693,115 | 9/1972 | Edson | 333/203 |
| 3,728,731 | 4/1973 | Choi et al. | 333/202 X |
| 3,733,608 | 5/1973 | McGhay et al. | 333/132 X |
| 3,939,443 | 2/1976 | Biró et al. | 333/202 |
| 4,007,434 | 2/1977 | Fletcher et al. | 333/171 |
| 4,061,992 | 12/1977 | Inokuchi | 333/202 |

OTHER PUBLICATIONS

Cohn–"Direct Coupled–Resonator Filters", Proceedings of the IRE, Feb. 1957; pp. 187–196.

Kurzrok–"Design of Comb–Line Band–Pass Filters", IEEE Trans. on Microwave Theory and Techniques, vol. MTT –14, No. 7, Jul. 1966; pp. 351–353.

*Primary Examiner*—Marvin L. Nussbaum

*Attorney, Agent, or Firm*—James A. Scheer; James W. Gillman

[57] ABSTRACT

A helical resonator filter with increased bandwidth is provided for use as a wideband bandpass filter. The device is composed of a series of helical resonators cells cascaded with non-uniform cell spacing, thus providing an increase in coupling coefficients between cells. The increased bandwidth is thereby obtained without placing a burden on the exterior housing dimensions relative to a normally spaced narrow bandwidth filter and without substantially reducing the unloaded Q's or increasing insertion losses.

4 Claims, 2 Drawing Figures

WIDE BANDWIDTH HELICAL RESONATOR FILTER

BACKGROUND OF THE INVENTION

This invention relates generally to bandpass filters suitable for use at very high and ultra high frequencies and, more particularly, to a filter composed of cascaded helical resonators with non-uniform spacing between resonant circuit elements.

It is well known that a space completely enclosed by conducting walls can contain oscillating electromagnetic fields within it and will possess certain resonant characteristics. Resonators of this type are commonly termed cavity resonators and are extensively used for filtering applications. A helical resonator is one member of a family of slow-wave transmission lines often used in the very high and ultra high frequency ranges and consists of a helix placed within a metal cavity. This form of resonator provides a minimum practical resonator size for a given frequency and hence is very useful in applications where compactness is essential.

FIG. 1 illustrates such a prior art helical resonator bandpass filter. Here a series of helical resonators, one being shown at 10, are positioned within cavities, will all cavities being the same size and being aligned in cascade. A series of apertures, one of which is shown at 12, provide for a predetermined coupling between the resonators. One end of each coil, such as coil 10 at 16, is directly connected to the metal cavity whereas the other end is floating (open) in fixed facial relationship to an adjustable screw 14 to allow controlled capacitive loading of the coil. Thus the distributed inductance of each coil, with its adjustable and distributed capacitance to the cavity, form a resonant circuit, tunable within a narrow range, within the cavity. When the resonator cavity cross-section is square, the distance between the resonators is a constant.

In order to increase the bandwidth of this type of resonant filter, the coupling between the resonators can be increased. A widely used technique for accomplishing this increase in coupling is to widen the aperture between resonators. A problem with such prior art resonators is that, even if the apertures between elements are increased to the maximum (i.e. the partitions are completely removed), the bandwidth obtained is still too narrow for many applications.

Another approach utilizes adjustable capacitive coupling between resonators. Still another type of filter uses a resonant filter with coupling between the elements adjusted by rotating those elements relative to each other. Both of these two approaches uses an adjustable coupling between elements rather than the fixed coupling preferred for many filter applications.

It has also been suggested that for coaxial resonators, increased coupling, and thus increased bandwidth, can be obtained by foreshortening resonators in one dimension thus placing the resonant stages closer together. This, however, results in a degradation of the resonator unloaded Q's and an increase in insertion losses.

SUMMARY OF THE INVENTION

It is therefore the object of this invention to provide an improved helical resonator bandpass filter which exhibits a wide bandwidth.

It is another object of this invention to provide a wide bandwidth filter having high unload Q's and low insertion loss within the passband.

It is another object of the present invention to provide an improved helical resonator bandpass filter which permits the use of the same cavity size over a wide range of frequencies.

In one aspect of the invention, a series of helical resonator cells are cascaded with non-uniform cell spacing. This non-uniform spacing permits some of the cells to be spaced closer to adjoining cells than others, resulting in an increase in coupling coefficients between the more closely spaced cells. An increased bandwidth is obtained as a result of this increased coupling without significant degradation of center resonator unloaded Q's or increases in passband insertion losses.

DETAILED DESCRIPTION OF THE INVENTION

Figure 1:
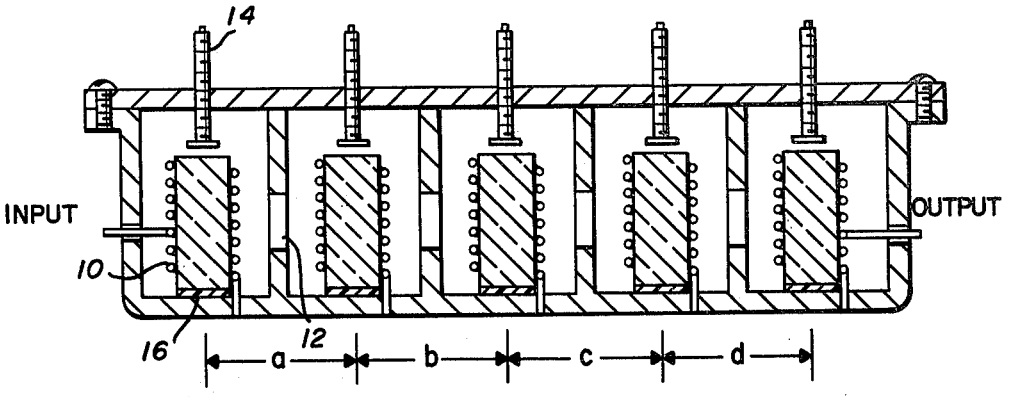
PRIOR ART Fig. 1
FIG. 1 is a cross-sectional view of a prior art helical resonator filter of the nature to which the present invention applies.
Figure 2:
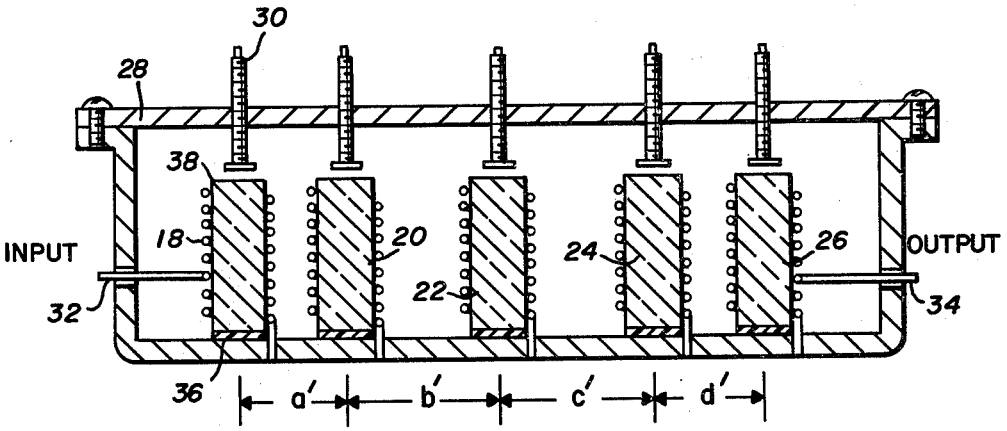
FIG. 2 is a cross-sectional view of a helical resonator filter arrangement which has been constructed in accordance with one embodiment of the present invention.

FIG. 2 illustrates the preferred embodiment of the novel helical resonator filter. The inventor has determined that the bandwidth of the filter may be increased by increasing the coupling between resonators. Thus the prior art resonator shown in FIG. 1 has been modified in two ways. First, the well known method of increasing aperture size to maximum has been used to increase coupling. Secondly, the inter-coil spacing is different from that of the prior art filter. In the embodiment shown in FIG. 2, the spacing between the first coil 18 and the second coil 20 as well as the spacing between coils 24 and 26 is less than the spacing between coils 20 and 22 and spacing between coils 22 and 24 (i.e. a' and d' are less than b' and c'). This increases the coupling between the coils thereby providing an increase in bandwidth while at the same time maintaining a high unloaded Q and low insertion losses.

Structurally the helical resonator filter is made up of a series of helical resonator cells which are aligned in cascade. In the prior art configuration illustrated in FIG. 1, the helical resonator cells are square and thus the distance between each helix is uniform. For the instant invention, the helical resonator cells on each end are rectangular and thus the distance between adjacent helixes is not uniform. It is also common for the helical resonator cells to be circular in cross section.

In each cell, a helical coil (for example; helix 18, FIG. 2) is connected to the metal cavity at one end 36, and the other end 38 is floating in a fixed spatial relationship to a screw 30 mounted in the cavity wall. Thus the distributed inductance of the coil with its distributed capacitance to the cavity walls forms the equivalent of a resonant circuit within its own cavity. The dimensions of the helix are chosen so that it forms a quarter wave resonator. As a result, the resonant frequency of each cell is primarily determined by the dimensions of the coil and the spatial relationship of the coil relative to the cavity wall.

As has been previously mentioned, the bandwidth of the cascaded helical resonator filter can be varied by varying the coupling between the coils. Thus in the preferred embodiment of FIG. 2, the aperture between each cascaded cell has been increased to maximum by removing the partitions completely. This results in what appears to be one large resonant cavity, however, it should be pointed out that in this configuration each helical resonator continues to function as if it were an individual cell coupled to adjacent cells primarily by complex coupling. The signals are coupled into the resonator through an input 32, and are removed through an output 34. It is common to use a tap, as shown, to accomplish this input/output function.

A bandwidth greater than that obtainable by merely removing cell partitions is obtained by positioning the end coils 18 and 26 closer to the adjacent coils 20 and 24. This is equivalent to changing the cross sectional dimensions of the cell from square to rectangular thus giving a smaller cell spacing between the end cells. An increase in complex coupling between in the closer cells results the desired increase in bandwidth. As few as three cascaded resonators can be employed to construct a filter with the described non-uniform spacing.

It is well known that the unloaded Q of a helical resonator will be decreased by a decrease in cavity dimensions and at the same time insertion losses will be increased. Thus the result of moving all coils closer together would be a substantial decrease in unloaded Q and increase in insertion losses. To avoid this disadvantage only the end coils are moved closer to their adjacent coils. This permits the construction of a helical bandpass filter with enhanced bandwidth, without significant overall reduction of unloaded Q or degradation of insertion loss characteristics.

A further advantage of this invention is that the cavity housing need not be shortened along with the decrease in spacing. A higher frequency cascaded helical filter would not require closer spacing to achieve comparable bandwidths because the coupling is greater at higher frequencies. Thus the cavity housing used for a VHF helical filter can be used for a UHF helical filter. This is a distinct advantage when helical bandpass filters are used in a system designed to operate at both VHF and UHF frequencies.

As a practical example of a VHF filter of the illustrated embodiment of the present invention, the inventor has constructed such a filter for operation at a resonant frequency of approximately 142 MHz. The copper housing is 3.36 inches in length, 0.72 inch wide and 1.05 inches in height.

There are five helical coils the first and last of which have approximately 18 turns and the second, third and fourth having 16½ turns all with a length of approximately 0.6 inches and centered relative to the sides of the cavity. The first and last coil have more turns in order to compensate for loading effect of the input and output taps. Tuning screws are mounted in the housing adjacent to the open end of each coil to provide for fine tuning of each resonant cell. Each cell is nominally 0.66 inches square with the two outside helixes moved closer to their adjacent helixes so that the spacing between the outside pairs of coils is reduced to approximately 0.61 inches. Each helical coil has a mean diameter of 0.396 inches using 22 gauge copper wire.

The characteristics of the resulting filter show an insertion loss of one dB and a bandwidth at minus 2 dB of 18 MHz. A comparable device without the novel spacing feature of the present invention results in a filter with a bandwidth of approximately 13 MHz at minus 2 dB and comparable insertion loss. The novel construction used in this embodiment also results in a filter unit which uses a housing of the same dimensions as those required for a filter of similar characteristics operating at a higher frequency.

While a preferred embodiment of the invention has been described and shown, it should be understood that other variations and modifications may be implemented. It is therefore contemplated to cover by the present application any and all embodiments and variations that fall within the true spirit and scope of the basic underlying principles disclosed and claimed herein.

What is claimed is:

1. A wideband helical resonator device for use in a circuit responsive to applied high frequency signals comprising:

an elongated enclosure of conductive material;

at least three helical coils each connected at one end to the inner surface of said enclosure, and arranged so as to have predetermined, and fixed, non-uniform spacing, and with the second end of each coil maintained in a fixed spatial relationship to said enclosure, whereby a pre-selected resonant frequency and a pre-selected bandwidth is obtained;

means for input of high frequency signals; and means for output of high frequency signals.

2. The helical resonator device of claim 1 wherein there are five helical coils placed along the longitudinal axis of the enclosure such that the two end helixes are spaced closer to the adjacent coils than the spacing between the inner helixes.

3. The helical resonator device of claims 1 or 2 wherein an adjustable screw is mounted in the enclosure wall, adjacent to said second end of each helix, whereby the helical resonator can be fine tuned.

4. The method of constructing a helical resonator bandpass filter which filter displays enhanced bandwidth and low insertion losses comprising the steps of:

a. producing an elongated cavity composed of conductive material;

b. connecting at least three helical coils at one end to the inner surface of said enclosure with predetermined and fixed, non-uniform spacing;

c. mounting the second end of each coil in fixed spatial relationship to the walls of said enclosure;

d. providing means for coupling high frequency signals into one end of said enclosure; and e. providing means to extract a high frequency signal from the other end of the enclosure.

* * * * *